United States Patent [19]

Young

[11] 4,018,008

[45] Apr. 19, 1977

[54] LAPPING DEVICE

[76] Inventor: Francis M. Young, 13628 37th Ave. South, Seattle, Wash. 98168

[22] Filed: Mar. 17, 1975

[21] Appl. No.: 558,777

Related U.S. Application Data

[63] Continuation of Ser. No. 366,596, June 4, 1973, abandoned.

[52] U.S. Cl. ..... 51/26; 51/58

[51] Int. Cl.[2] ..... B24B 15/00

[58] Field of Search ..... 51/26, 58; 125/30

[56] References Cited

UNITED STATES PATENTS

| | | | |
|---|---|---|---|
| 175,390 | 3/1876 | Stover | 51/58 X |
| 249,523 | 11/1881 | Hessels | 51/26 X |
| 1,318,300 | 10/1919 | Robertson | 51/26 |
| 1,537,582 | 5/1925 | Cahart | 51/26 X |
| 2,039,852 | 5/1936 | Snyder | 51/26 |
| 2,480,028 | 8/1949 | Jones | 51/58 X |
| 3,160,870 | 12/1964 | Randall | 51/26 X |
| R14,751 | 11/1919 | Brockbank | 51/26 |

*Primary Examiner*—Harold D. Whitehead
*Attorney, Agent, or Firm*—George M. Cole

[57] ABSTRACT

Lapidary device for making composite jewelry from various combinations of stone pieces. The device has opposed jaws for holding two pieces of material together. By reciprocating one jaw a lap-grinding action is created which fits the two pieces together to give finely matched pieces of stone.

14 Claims, 6 Drawing Figures

LAPPING DEVICE

This is a continuation, of application Ser. No. 366,596, filed June 4, 1973, and now abandoned.

BACKGROUND OF THE INVENTION

The invention relates generally to lapidary equipment and more particularly to a machine for lap-grinding pieces of stone together to give a desired finish design from dissimilar and unmatched pieces of rock or stone.

Those familiar with the lapidary field are aware that there is no known machine in the field for closely matching pieces of stone to give a desired design for such items as jewelry and other ornamental specialties made of rock, stone and/or other grindable material and combinations thereof. The lack of such machine for the lapidary hobbyist led to development of the instant invention. Although there are no known prior art patents relating directly to this type of device, the following U.S. Pat. may be of interest, ie. Nos. 2,443,194; 2,423,777; 3,167,866 and 3,281,167.

SUMMARY OF THE INVENTION

The invention comprises a rigid three point support base. The base has pivotally mounted at one end a pivot frame arm which extends to near the other end of the base. At one end of the pivot arm frame is a movable clamping assembly. Located in juxtaposition on a vertically stationary mounting is another clamping assembly. Pieces or slabs of material to be lapped together are clamped in the jaws. An oscillatory mechanism is attached to the pivot arm frame so that one work piece is moved rapidly up and down with respect to the stationary piece. The length of the frame arm stroke can be adjusted as can the center line of the stroke. A small catch basin is provided to capture oil and grit running off the work pieces. The stationary clamping assembly is spring loaded for resiliently pressuring the clamping assemblies and particularly the work pieces together.

Accordingly, it is among the many features and advantages of this invention to supply a lapping machine which is uniquely simple in design, relatively inexpensive, rugged and durable. The machine is designed so that rotating parts are bearing-mounted and thus operation is quiet. The device provides for an adjustable length stroke in the pivot arm and a stroke positioner with respect to the center of the work pieces. The unique capabilities of this device enable the operator to design monograms, silhouettes, floral designs, pictures, landscapes and other patterns. In addition to working stone, the device can be used to work metals, plastic, glass, ivory and nearly any other substance which is capable of being ground. The frame is rigid with all other components mounted to form a compact and practical operating unit. Pieces of different thickness or hardness can be lapped together. The finished and lapped pieces of stone or other material are externally shaped to standard template sizes so that mountings can be purchased as off-shelf items.

DESCRIPTION OF PREFERRED EMBODIMENT

Figure 6:
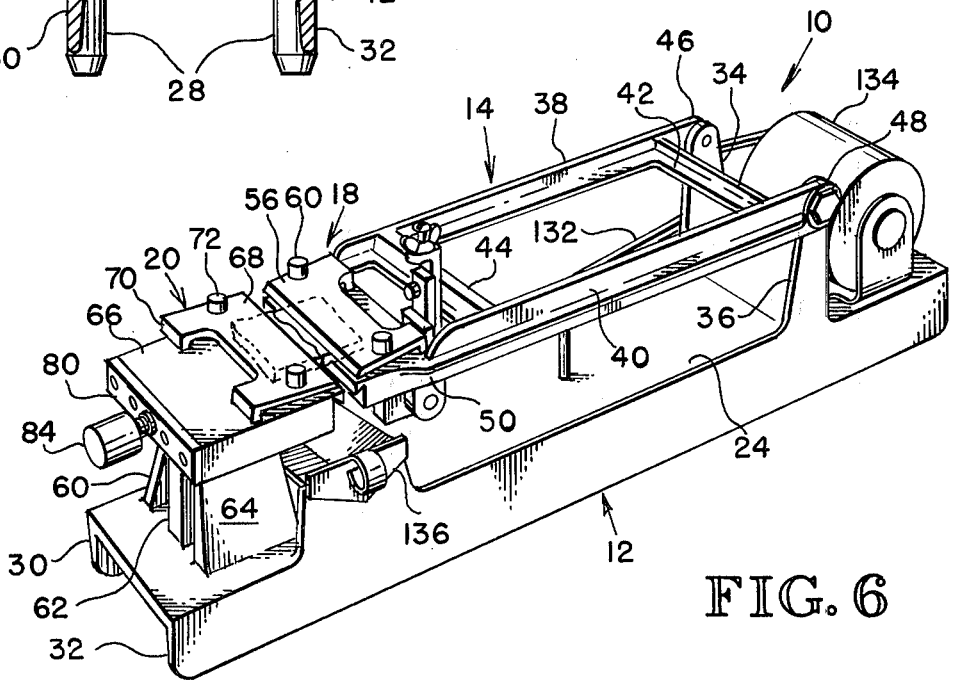
FIG. 6 is a view in perspective further illustrating details of the invention.

Referring now to the drawings, and particularly FIG. 6, it will be seen that the invention which is generally described by the number 10 includes a base section generally identified by the number 12, a pivot arm assembly generally designated by the number 14, an eccentric and stroke adjustment assembly generally designated by the number 16, a movable clamp assembly generally designated by the number 18, and a stationary feed clamp assembly generally designated by the number 20. The base 12 is a generally elongated rectangular casting having main support surface 24, single support leg 26 at the work piece end of the base and a pair of spaced support legs 28 at the other end of base 12. Thus the base is provided with a three point support for stability. The base unit is provided with depending skirt means 30 and 32 on either side of the base and extending from end to end thereof. Disposed above spaced apart legs 28 at the pivot end of the base are a pair of upstanding spaced apart pivot arm mounts 34 and 36 which are also preferably an integral part of the cast base unit 12. It will be seen that the arm mounts 34 and 36 extend upwardly several inches above support surface 24.

Pivot arm assembly 14 also is preferably a cast unit generally rectangular in shape as can be clearly seen in the drawings. The arm assembly has side-frame members 38 and 40 and cross-frame members 42 and 44. It will be noted that pivot arm assembly 14 has two connector portions 46 and 48 extending rearwardly of side-frame members 38 and 40. The connector portions are pivotally secured to mounts 34 and 36. At the forward end of the arm assembly 14 and spaced forwardly of front cross-frame member 44 is a jaw section 50 which presents a generally flat support surface for the movable clamp assembly 18. The extreme front end of arm assembly 14 is provided with a depending beveled lip which can best be seen in FIGS. 2 through 4. This comprises beveled surfaces 52 extending generally from each side of the jaw and angling downwardly from the sides to a point 54. In this way oil and grit from the work pieces will run down the face 53 and onto the beveled surface 52 to the point 54 and run off into a drip trough disposed below and extending across the machine. The beveled surfaces 52 which converge to point 54 serve to prevent drippage of oil at random locations from the work pieces and the jaws.

Mounted on surface 50 is a generally rectangular jaw plate member 56 having a rear depending ledge portion or portions 58 which spaces the under side of the jaw plate 56 above surface 50. A pair of knurled thumb screws 60 clamp jaw plate 56 onto the work piece.

Figure 3:
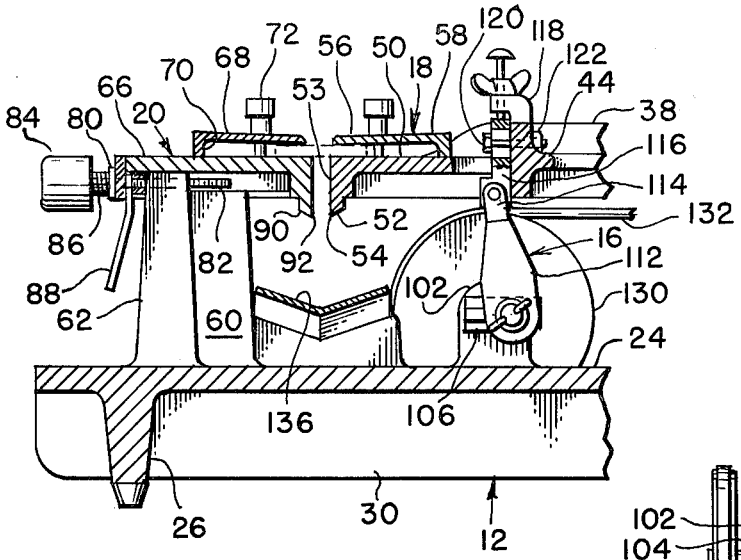
FIG. 3 is a partial elevational cross-sectional view taken along the line 3—3 of FIG. 1 showing details of the jaws and stroke centering adjustment features of the device.
Figure 4:
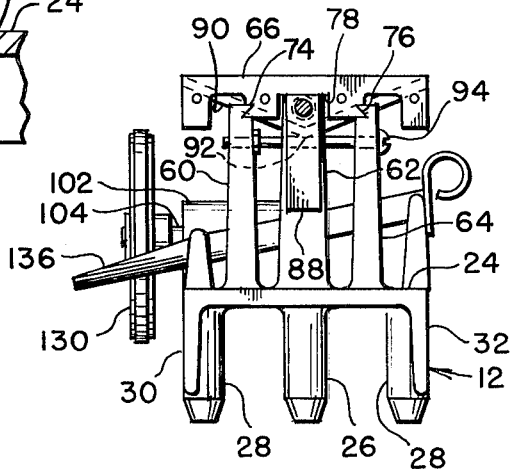
FIG. 4 is an elevational cross-section view taken along the line 4—4 of FIG. 2 showing further details of the device.

A stationary jaw assembly is provided adjacent the movable jaw which has just been described. As can best be seen in FIGS. 3 and 4 the base member 12 is provided with two upstanding stationary clamp mounts 61 and 64. It will be seen that a center standard 62 extends slightly higher than the two mounts 61 and 64 but it does not serve as a mount for the jaw assembly. Supported on the two mounts, which are also shown to be integrally cast with the base assembly 12, is stationary clamping assembly 20 comprising support plate 66 on the top of which is jaw plate 68 with depending ledge portion 70 to space the clamping plate 68 above surface 66. As with the other jaw assembly knurled thumb screws 72 are provided to securely hold the work pieces in place for the lapping operation. Support plate 66 is designed for resiliently loaded longitudinal movement so that as the lapping operation proceeds the work pieces can be maintained in close grinding contact with each other. To this end the under side of plate 66 is provided with triangular guide portions 74 and 76 which are received in matching grooves in outside mounts 61 and 64 as best seen in FIG. 4. Between the guide portions 74 and 76 is a rectangular groove 78 which permits the center upstanding standard 62 to clear the jaw assembly so the same is free to move horizontally on mounts 61 and 64.

At the front end of plate 66 is a removable bar 80 having a central opening therein through which extends an elongated threaded bolt 82 with knurled head 84. Bolt 82 extends from head 84 through bar 80 and is threadedly received in standard 62. Between head 84 and bar 80 is a compression spring 86 which spring loads the entire jaw assembly 20 toward the vertically oscillating jaw assembly 18. It will be appreciated that as the lapping operation progresses spring 86 will force the support plate 66 towards the opposed and reciprocating jaw assembly with a substantially continuous and yet resilient force. As the jaw assembly 20 and plate 66 move towards the opposite jaw the distance between the inside surface of bar 80 and the front edge of mount 62 diminishes. Once bar 80 has advanced far enough so that it butts against mount 62 the jaw assembly no longer can be resiliently urged or moved towards the other jaw assembly. A light piece of metal 88 with an opening at the top thereof is placed on bolt or threaded member 82 to indicate that there is feed movement available to plate 66. Once metal bracket 88 no longer hangs loosely, that is, it is caught firmly between bar 80 and standard 62, the operator will appreciate that he will have to reset the jaw so that again there is feed room between bar 80 and mount 62. In this way the jaw is spring loaded so that the work pieces held between the jaws may be brought together at the correct contact pressure for an effective lapping operation. It will also be appreciated that plate 66 has at the work end thereof a pair of downwardly angling and converging beveled surfaces 90 coming together to point 92 similar to the opposite jaw. Extending between the two outside mounts 61 and 64 is an adjustment bolt 94 which determines how tightly the guide positions 74 and 76 are received in the triangular guideways in the two outside mounts 61 and 64.

Figure 5:
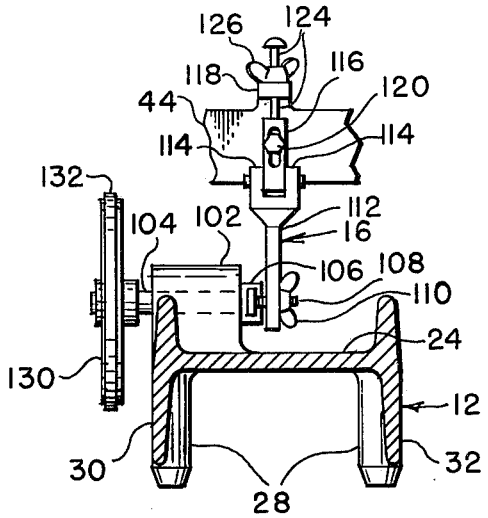
FIG. 5 is a partial transverse cross-section along the line 5—5 of FIG. 1 showing additional details of the stroke centering adjustment mechanism.

It will be seen that the pivot arm assembly 14 is pivotally mounted by bolts 100 to posts 34 and 36. The forward or work piece end of arm assembly 14 has approximately at the center of cross-frame member 44 an eccentric drive mechanism and stroke adjustment feature 16. A bearing housing 102 preferably integrally formed on base assembly 12 contains bearings not shown for drive shaft 104. Connected to the inner end of shaft 104 is a stroke block 106 having a T-shaped groove therein into which is slidably received the head of a bolt-like member, the shape of which can best be seen in FIG. 5. The stroke block 106 is an elongated rectangular member which rotates with shaft 104. The elongated T-groove enables the threaded adjustment member 108 to be positioned anywhere along the length of the groove to vary the stroke as desired by the distance threaded member 108 is off center of shaft 104. A wing nut 110 is received on threaded member 108.

Figure 1:
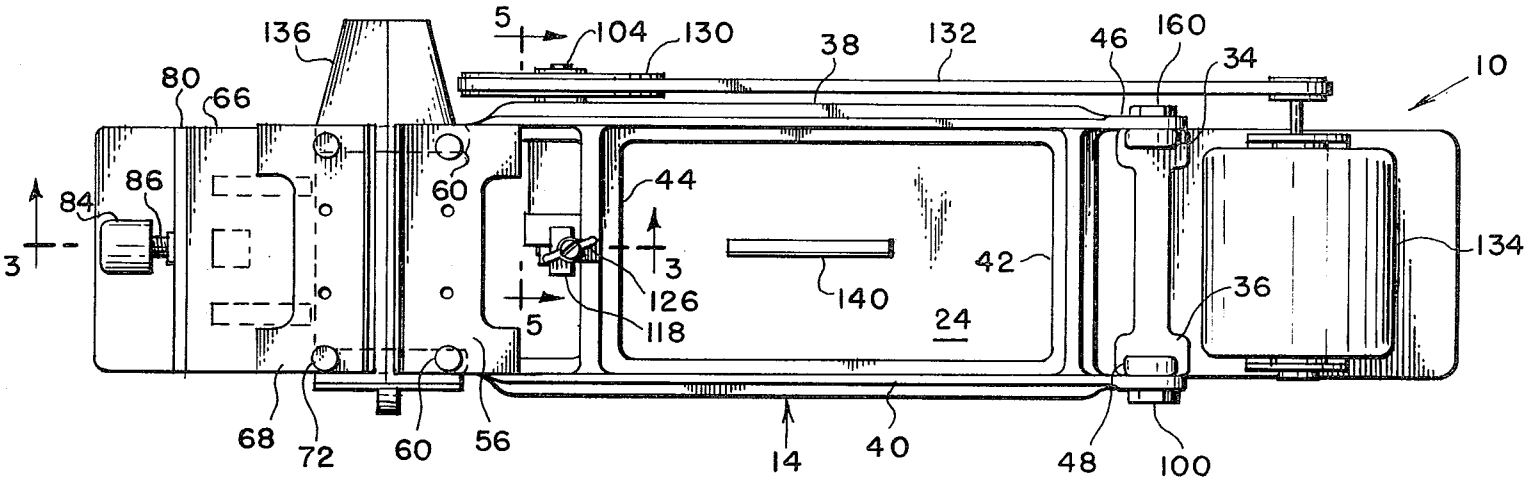
FIG. 1 is a top plan view of the invention.
Figure 2:
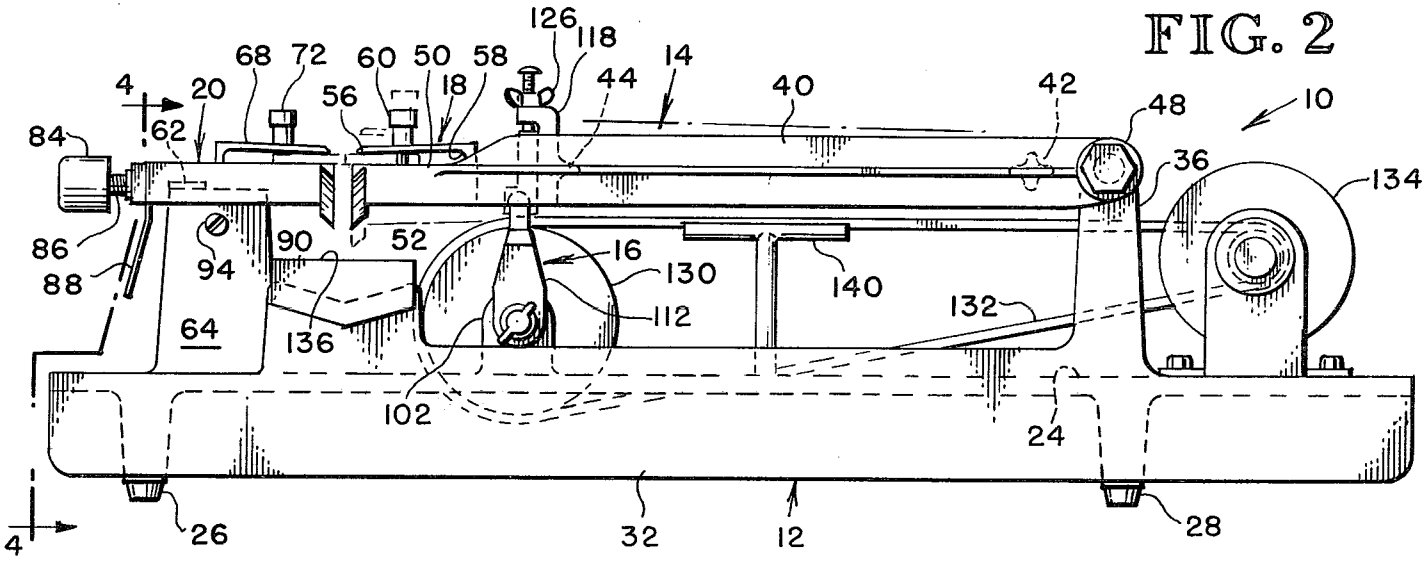
FIG. 2 is a side elevation view to further illustrate details.

Mounted for pivotal movement with respect to the threaded member 108 is crank arm 112 which has an opening at the lower end thereof to be received on member 108 and a yoke at the upper end thereof for pivotal connection to an adjustment bar member. The yoke arms 114 are connected to stroke adjustment bar 116. It will be noted that an adjustment bar mounting 118 is secured to front cross-frame member 44 or formed as an integral part thereof as shown. Adjustment bar 116 is sloted to receive bolt 120 which extends through cross-framemember 44 where it is secured by wing nut 122 as can best be seen in FIG. 3. A retainer bolt 124 extends through the top of adjustment mount 118 and butts against the top end of adjustment block 116. It will be appreciated from the foregoing description that stroke block 106 enables the operator to determine the amount of stroke through which movable jaw assembly 18 is oscillated. The adjustment block 116 and bolt 120 permit the stroke to be centered or positioned so that the work pieces between the jaws are constantly in contact. Put another way, the stroke is centered with respect to the stationary work piece. On the outside end of shaft 104 is pulley 130 connected by belt 132 to motor pulley 133 and motor 134 at the rear of the base unit. A drip trough 136 is placed under the jaws to receive oil and grit dripping off the work pieces and off the beveled surfaces 52 and 90. The drip trough can be seen to extend across the width of the base at an angle. A cup or other small container may be placed under the lower end to receive the grit-containing lubricant and coolant oil. A T-bar handle 140 may be provided as shown in FIGS. 1 and 2 for lifting and carrying the device.

In operation the pieces of stone are rough cut to the approximate configuration desired in the matching pieces. The two work pieces are then clamped in the jaw assemblies with caulking cord along the edges of the clamp and around the back of each piece of stone to form a dam to prevent the oil and grit from running through and into threaded holes. In this way the oil will be confined to the area around the work pieces and between the same. The grinding operation is done with a mixture of light oil and preferably a 400 mesh silicon carbide grit which is applied with a small brush to the work pieces as the machine runs. The spring loading of the stationary jaw permits resilient contact of the surfaces or edges to be matched. For purposes of illustration only 10 minutes to an hour and a half may be required, depending on the area of the work pieces being fit, to advance the cutting till the pieces fit along the desired line. The vertical reciprocation of the movable jaw assembly provides lap grinding action with the application of grit in light oil providing the abrasion necessary to fit the two pieces together. The finished and matched contact line is barely discernible by the human eye. Pieces of different thickness or hardness can be lapped together since the grit cuts both pieces at the same time and therefore the cutting rate of the grit on both pieces is nearly the same. Metals can be worked into stones to produce realistic designs, patterns, silhouettes, pictures, monograms or any combination of colors or pieces of gem stone in all sizes. The external shape of the meshed pieces is usually to standard template sizes to that mountings can be purchased as off-shelf items

What is claimed is:

1. Lapping device for abrasively grinding two work pieces together to form a matched fit thereof, comprising:

a. a supporting base, b. a first clamping assembly on said base for holding one work piece and being designed for generally vertically reciprocable movement, said first clamping assembly including a generally flat first surface on which said one work piece is supported and a first clamping plate for bearing down on and holding one work piece in place on said first surface, said first plate being shaped so as to allow access to an overhanging edge portion of said one work piece, c. a second clamping assembly positioned for holding another work piece against said one work piece, said second clamping assembly being vertically stationary and mounted for generally horizontal movement towards and away from said first clamping assembly, said second assembly including a second clamping plate for bearing down on and holding said other work piece in place on generally flat second surface, said second plate being shaped generally like said first plate so as to allow access to an overhanging edge portion of said other work piece, d. means for driving said first clamping assembly through an up-and-down stroke generally perpendicular to said flat first and second surfaces for a predetermined distance movement so that said work pieces are not out of contact with each other while being worked, and e. said second clamping assembly including resilient means for biasing the same towards said first clamping assembly to resiliently urge said work peices together.

2. The lapping device according to claim 1 and wherein said first clamping assembly is supported on a pivotally mounted arm assembly.

3. The lapping device according to claim 2 and wherein said drive means includes stroke adjustment means for setting said arm assembly and first clamping assembly to a desired predetermined stroke distance movement.

4. The lapping device according to claim 3 and wherein said drive means is provided with a stroke centering adjustment whereby the stroke movement of said first clamping assembly can be adjusted with respect to said second clamping assembly.

5. The lapping device according to claim 3 and wherein said drive means includes an eccentric mechanism having a stroke adjustment block and crank arm.

6. The lapping device according to claim 1 and in which each of said clamping assemblies is provided with beveled edge means for controlling oil drippage to a defined area.

7. The lapping device according to claim 6 and in which an oil receiving trough is provided generally below said beveled edge means.

8. The lapping device according to claim 1 and wherein said base includes three supporting legs for three point support thereof.

9. Lapping device for abrasively grinding two work pieces together to form a matched fit thereof, comprising:

a. an elongated, generally rectangular supporting base having arm assembly mount means towards one end and second clamping assembly mount means towards the other end thereof, b. an arm assembly frame pivotally mounted on said arm mount means, c. a first clamping assembly on said arm for holding one work piece and together with said arm being designed for generally vertically reciprocable movement, said first clamping assembly including a generally flat first surface on which said one work piece is supported and a first clamping plate for bearing down on and holding said one work piece in place one said first surface, said first plate being shaped so as to allow access to an overhanging of said one work piece, d. a second clamping assembly on said second assembly mount means positioned for holding another work piece against said one work piece, said second clamping assembly being vertically stationary and mounted for generally horizontal movement towards and away from said first clamping assembly, said second assembly including a generally flat second surface on which said other work piece is supported and a second clamping plate for bearing down on and holding said other work piece in place on said second surface, said second plate being shaped generally like said first plate so as to allow access to an overhanging edge of said other work piece, e. drive means for said arm assembly and first clamping assembly including a drive shaft and means connected thereto to impart up-and-down movement generally perpendicular to said flat first and second surfaces for a predetermined distance to said arm assembly, so that said work pieces are not out of contact with each other while being worked, and f. said second clamping assembly including resilient means for biasing the same towards said first clamping assembly to resiliently urge said work pieces together.

10. The lapping device according to claim 9 and wherein said drive means includes stroke adjustment means connected to said drive shaft for setting said arm assembly and first clamping assembly to a desired predetermined stroke movement distance.

11. The lapping device according to claim 10 and wherein said drive means is provided with a stroke centering adjustment whereby the stroke movement of said first clamping assembly can be adjusted with respect to said second clamping assembly.

12. The lapping device according to claim 10 and wherein said stroke adjustment means is an eccentric mechanism having a stroke adjustment block and crank arm.

13. The lapping device according to claim 9 and in which each of said clamping assemblies is provided with beveled edge means for confining oil drippage to a defined area.

14. The lapping device according to claim 13 and in which an oil receiving trough is provided generally below said beveled edge means.

* * * * *